United States Patent [19]

Scholl et al.

[11] Patent Number: 4,696,242

[45] Date of Patent: Sep. 29, 1987

[54] SEWING MACHINE

[75] Inventors: Hans Scholl, Oerlinghausen-Lipperreihe; Horst Thiele; Eckhard Hägemann, both of Bielefeld, all of Fed. Rep. of Germany

[73] Assignee: Kochs Adler Aktiengesellschaft, Del.X

[21] Appl. No.: 944,433

[22] Filed: Dec. 18, 1986

[30] Foreign Application Priority Data

Dec. 28, 1985 [DE] Fed. Rep. of Germany ..... 3546238

[51] Int. Cl.[4] ..... D05B 21/00

[52] U.S. Cl. ..... 112/121.14

[58] Field of Search ..... 112/121.14, 121.12, 112/121.15, 102, 103, 121.11, 2, 304, 311

[56] References Cited

U.S. PATENT DOCUMENTS 3,839,973 10/1974 Cummins et al. ..... 112/121.14
4,362,077 12/1982 Gerber ..... 83/453
4,457,243 7/1984 Bowditch ..... 112/121.14
4,494,470 1/1985 Fischer et al. ..... 112/121.12
4,503,789 3/1985 Scholl ..... 112/121.14
4,513,677 4/1985 Scholl ..... 112/121.14 X

*Primary Examiner*—Peter Nerbun

*Attorney, Agent, or Firm*—Laff, Whitesel, Conte & Saret

[57] ABSTRACT

A sewing machine has a sewing head and at least one workpiece holder for receiving the workpiece. The sewing head and the workpiece holder are movable relative to one another in two coordinate directions. In order to be able to adequately secure the workpiece in the workpiece holder, below the latter is provided a supporting plate which supports the latter and which is fixed in one coordinate direction (x-direction) relative to the sewing head, extends at least over the maximum relative movement in said coordinate direction (x-direction) and has a recess extending in the other coordinate direction for the passage of a needle. Between the supporting plate and the workpiece holder is provided a supporting belt, which is fixed relative to the workpiece holder in both coordinate directions.

9 Claims, 10 Drawing Figures

X
IV
III
IX
1
2
3
4
5
7
8
8a
9
10
12
13
14
15
17
19
20
21
22
25
26
27
28
29
31
32
34
41
43
44
45
46
57
58
59
60
61
62
63
64
65
66
68
70
76
77
78
83
84
85
94
94a
103

41
59
70
96
97
98

Fig. 7
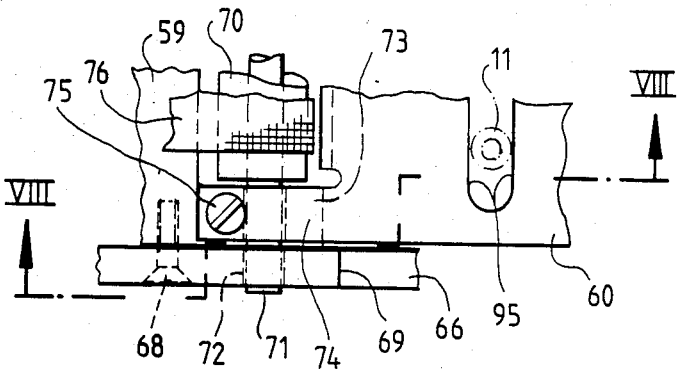
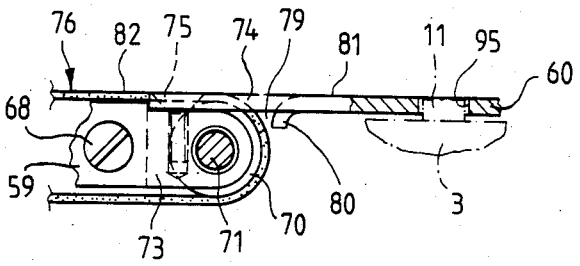
Fig. 8
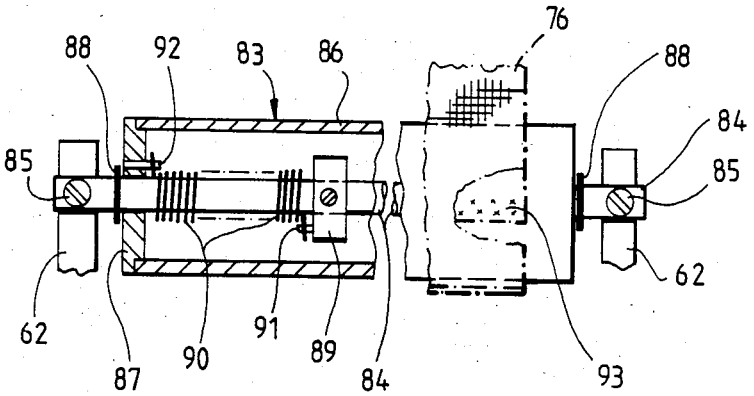
Fig. 9
Fig. 6
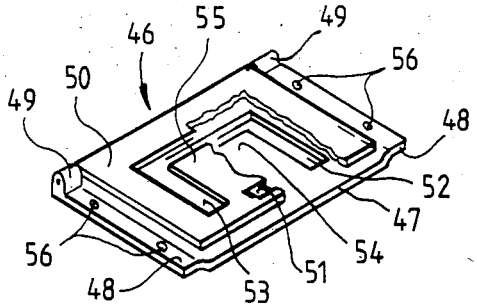

SEWING MACHINE

BACKGROUND OF THE INVENTION

The invention relates to a sewing machine controlled by a computer for producing a relative movement between a sweing head with a needle and at least one workpiece holder receiving a workpiece to be sewn during a sewing process in a plane substantially perpendicular to a direction of movement of the needle, whereby for producing said relative movement in two coordinate directions at right angles to one another servomotors controlled by said computer are provided for moving said sewing head relative to the at least one workpiece holder and whereby at the end of a sewing process the sewing head and the workpiece holder are brought into a position relative to one another in which the workpiece holder is free from the sewing head.

In such a sewing machine known from U.S. Pat. No. 4,503,789 two juxtaposed workpiece holders are adjacently arranged in one coordinate direction in a fixed work plate and can be alternately supplied, namely when the workpiece portions located in the other workpiece holder are to be sewn together. Such workpiece holders conventionally comprise a relatively thin lower plate and an upper plate pivotable with respect thereto in the manner of a cover and between which are clamped the workpiece portions to be sewn together following the closing of the workpiece holder. Recesses are provided in the upper and lower plates corresponding to the seam configuration to be produced. Particularly if the start and finish of the seam to be produced are relatively close together, then the plate section surrounded by the recess in the lower plate is relatively unstable, i.e. flexible. This more particularly applies in view of the fact that the lower plate is very thin, so that the material to be sewn which bridges the recess cannot be drawn out downwards. Particularly if relatively narrow parts are to be sewn together, there is a risk that they will not be adequately secured between the upper plate or its plate portion surrounded by the recess and the lower plate or its plate portion surrounded by its recess.

U.S. Pat. No. 3,839,973 discloses a sewing machine having two endless belts for the transfer of the workpiece. These two endless belts leave a narrow slit free between them in the vicinity of the stitch formation point. They are both synchronously driven in such a way that the workpiece is correspondingly guided over the stitch formation point. In order to keep the workpiece on said belts, it is subject to vacuum action from below through said belts.

U.S. Pat. No. 4,362,077 discloses a cutting mechanism where, above a cutting table, is provided a cutting head which can move in two coordinate directions. For pressing the cutting material flexible belts of ferromagnetic material are provided parallel to one another and accompanied by the clamping of the cutting material by means of fixed magnets in the cutting table are pressed against the same. The belts are formed into a loop in the cutting head and are guided over pulleys adjacent to the cutting point, so that the latter is always free.

SUMMARY OF THE INVENTION

A primary object of the invention is to provide a sewing machine in which the workpiece is adequately secured in the workpiece holder.

According to the invention, below the at least one workpiece holder a supporting plate is provided supporting the at least one workpiece holder and which supporting plate is fixed relative to said sewing head in one of said two coordinate directions and which supporting plate extends at least over the maximally possible relative movement in said one coordinate direction and which has a recess extending in the other one of said two coordinate directions for a passage of the needle. The inventive measures ensure that the lower plate of the workpiece holder and more particularly its plate section surrounded by the recess corresponding to the seam configuration is firmly secured, so that once again there is satisfactory claming of the workpiece parts between the lower plate and the in principle randomly rigidly constructable upper plate of the workpiece holder. The inventive measures make it unnecessary to on each occasion remove the workpiece holder from the sewing machine for charging purposes, because there is no longer any risk of damage to the thin and very soft lower plate of the workpiece holder. There is also no risk of injury to the operator. The firm supporting of the lower plate of the workpiece holder facilitates the insertion of the workpiece parts, without having to remove the workpiece holder from the work plate of the sewing machine. This applies more particularly in the case of so-called "island workpiece parts", i.e. workpiece parts only clipped in small edge regions and not all around.

Furthermore, a supporting belt is provided between the supporting plate and the at least one workpiece holder, which supporting belt is fixed relative to said workpiece holder in both coordinate directions. These particularly advantageous and inventive measures ensure that there is no relative movement between the supporting plate on the one hand and the lower plate of the at least one workpiece holder on the other during the relative movement between the sewing head and the workpiece holder in one coordinate direction. The relative movement takes place between the supporting belt and the supporting plate.

When the supporting belt is located outside the workpiece holder and is fixed with respect thereto and is passed round a guide in the vicinity of said recess for the passage of the needle and when a device is provided for drawing in or releasing the supporting belt corresponding to the relative movements between the supporting plate and the workpiece holder in the one of said two coordinate directions, it is ensured that the supporting belt portion which is freed or used on moveing the supporting plate relative to the workpiece holder is drawn away downwards or supplied from below.

Other problems, advantages and features of the invention can be gathered from the following detailed description of a preferred embodiment, with reference to the drawings.

BRIEF DESCRIPTION OF THE DRAWINGS

FIG. 6 is a perspective view of a workpiece holder;

FIG. 7 is a detail VII taken from FIG. 3 on a larger scale;

FIG. 8 is a vertical section through FIG. 7 taken on the section line VIII—VIII in FIG. 7;

FIG. 9 is a view of a tightening and winding roll taken in the direction of arrow IX in FIG. 2 in a partly broken-away representation.

DESCRIPTION OF PREFERRED EMBODIMENT

Figure 1:
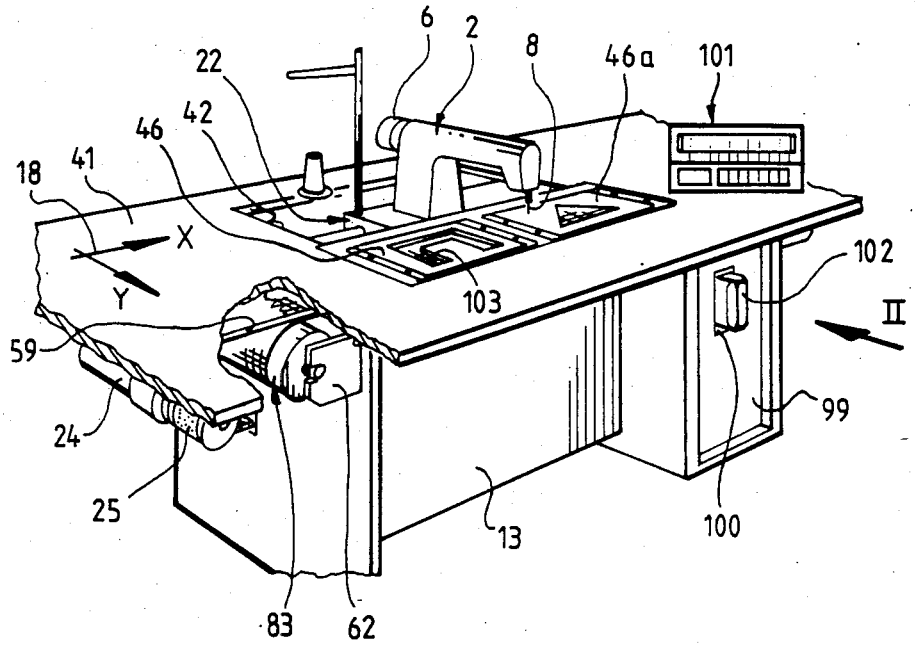
FIG. 1 is a perspective view of a sewing machine.

In the case of the sewing machine shown in the drawings, a sewing head 2 is placed on a frame 1 and comprises an arm-shaped base plate 3, a standard 4 rising vertically therefrom and an arm 5 extending horizontally therefrom and approximately parallel to the base plate 3. To the arm 5 is fitted a drive motor 6, which is driven up and down by means of a not shown arm shaft of a needle bar 7 mounted in the arm 5 and having a needle 8. The needle bar 7 with the needle 8 describes a movement in the direction of the double arrow 8*a*. In the base plate 3 is provided a looper 9, which is driven synchronously to the needle bar 7 in conventional manner by means of a drive element within the sewing head 2. With the looper 9 is associated a thread cutter 10. For stitch formation purposes, the needle 8 is introduced into a stitch hole 12 formed in a mushroom-shaped tubular stud 11 on the base plate 3.

The frame 1 has a supporting frame body 13 with an upper horizontal supporting surface 14 and side walls 15. On the supporting surface 14 are provided two parallel, spaced, rod-like guide bars 16, 17 which, based on a coordinate system 18, extend in the y-direction. A carriage called the x-carriage 19 is displaceably arranged on said guide bars 16, 17.

On said x-carriage 19 are provided horizontal, parallel, spaced, rod-like guide bars 20, 21 which extend in the y-direction in accordance with the coordinate system 18. A carriage called the y-carriage 22 is displaceably arranged on said guide bars 20, 21. The sewing head 2 is fixed by means of screws 23 to the y-carriage 22.

The x-carriage 19 is driven by means of a servomotor 24 fixed to the frame 1 via a timing belt 25. For this purpose a timing belt pulley 27 is fixed in non-rotary manner to the shaft 26 of the servomotor 24 and around it is wound the endless timing belt 25. In a bearing 28 is mounted a guide roller 29 around which the timing belt 25 is also looped. The upper strand 30 of the timing belt 25 is fixed to the x-carriage 19. The lower strand 31 is housed in a channel-like recess 32 in the supporting surfaces 14 of the frame body 13.

The drive for the y-carriage 22 is placed on the x-carriage 19. This drive also has a servomotor 33 fitted to the x-carriage 19 and which drives the y-carriage 22 by means of an endless timing belt 34. The latter is guided on the one hand by means of a timing belt pulley 36 fitted in non-rotary manner to the shaft 35 of the servomotor 33 and on the other hand by means of a guide roller 37, which is supported and secured on the x-carriage 19 by means of a bearing 38. The upper strand 39 of the timing belt 34 is connected by means of a clamping device 40 to the y-carriage 22. A similar clamping device is provided between the upper strand 30 of the timing belt 25 and the x-carriage 19.

On the frame 1 is provided a work plate 41, which has a cutout 42, through which the sewing head 2 passes upwards and within which the sewing head 2 can be moved in the x- and y-direction in the manner described hereinbefore.

Two juxtaposed, rectangular, identical openings 43, 44 are provided in the work plate 41, upstream of the cutout 42 in the x-direction and are in each case provided with a frame-like supporting margin 45 for in each case one workpiece holder 46, 46*a*, received in the particular opening 43 or 44 so as to be non-displaceable in the x- and y-direction. The workpiece holder 46 in FIG. 6 has a lower plate 47, which has upwardly bent margins 48 for bearing on the supporting margin 45 of the work plate 41. By means of hinges 49 and upper plate 50 can be flapped up or flapped down onto the lower plate 47. By means of an elastic snap lock 51 it is connected in the downwardly flapped position to the lower plate 47, in order to secure a workpiece 103. In order to be able to position the workpiece 103 as near as possible above the stud 11, the lower plate 47 is very thin, e.g. made from 0.5 millimeter thick sheet steel. However, the upper plate 50 is thicker and is e.g. made from 2 millimeter thick sheet steel. Workpiece holders of this type are known from U.S. Pat. No. 4,503,789. Recesses 52, 53 are formed in the lower plate 47 and the upper plate 50, which are roughly congruent with one another and roughly correspond to the configuration of a seam to be produced in the workpiece 103. It can be seen in FIG. 6 that the recesses 52, 53 of the workpiece holder 46 have an approximately U-shaped configuration, so that between them there is in each case a plate section 54 or 55 in the lower plate 47 or the upper plate 50, which is relatively unstable and therefore does not secure adequately firmly the workpiece 103 to be sewn. In margins 48 are provided holding and centering bores 56, which are traversed by shoulder screws 57, in order to screw down the workpiece holder 46 or 46*a* on the supporting margin 45 in a precisely positioned manner.

Generally such workpiece holders can also be constructed in such a way that several individual workpiece parts resting on one another can be positioned and secured with respect to one another and in general. In such a case the workpiece holder can also have a further plate arranged on the hinge and between the upper and lower plates. Workpiece holders of this construction are e.g. marketed by the Applicant under article number 976 41 013 4 for use in a Kochs Adler K1 976-S 500 sewing machine.

Below the work plate 41 is provided a supporting plate 58, which comprises two outer supporting plate portions 59 and a central supporting plate portion 60 which, as will be described hereinafter, are joined together. The outer supporting plate portions 59 are supported on the supporting rollers 61, which are in each case mounted in freely rotatable manner and bearing flanges 62 fitted to the frame body 13. The supporting plate 58 together with the x-carriage 19 can be moved in the x-direction. For lateral guidance purposes, the supporting rollers 61 have lateral rims 63.

For joining the supporting plate 58 to the x-carriage 19 on the latter are fitted vertically upwardly projecting plates 64, 65 extending in the y-direction and to which are fixed bearing plates 66, 67 extending in the x-direction and which have a reciprocal spacing corresponding to the width of the supporting plate 58. On and between the bearing plate 66, 67 the outer supporting plate portions 59 are fixed by means of screws 68, so that during movements of the x-carriage 19 they are drawn along in the described manner. The bearing plate 66 contains an upwardly open U-shaped recess 69, into which projects the base plate 3 of the sewing head 2.

On the end of each outer supporting plate portion 59 adjacent to the central supporting plate portion 60 is provided a guide roll 70, which is mounted in freely rotatable manner with axle journals 71 in corresponding bearing bores 72 in the bearing plates 66, 67. These axle journals 71 pass through side walls 73 projecting from the outer supporting plate portion 59, on which are supported the central supporting plate portions 60 with corresponding projecting lugs 74 and is fixed by means of holding screws 75.

On the underside of the work plate 41 laterally outside the bearing flange 62 one end of a supporting belt 76 is fixed by means of a clamping ledge 77 in a recess 78. These textile supporting belts 76 roughly have a width corresponding to that of the workpiece holder 46 or 46a in the y-direction. The supporting belts 76 are guided over the upper sides of the supporting plate portion 59 and around the guide rolls 70. At this point they are passed downwards through a slot 79 between the guide rolls 70 and the central supporting plate portions 60, which is defined by an offset 80 of the central supporting plate portion 60 and returned to the underside of the outer supporting plate portion 59.

As can be gathered from FIG. 8, the upper surface 81 of the central supporting plate portion 60 is aligned with the two upper surfaces 82 of the supporting belts 76 resulting on the outer supporting plate portion 59.

The supporting belts 76 are guided by the guide roll 70 to tightening and winding rolls 83. The latter have spindles 84, which are fixed to the bearing flanges 62 by means of screws 85.

The rolls 83 in each case comprise a hollow cylinder 86 arranged concentrically to the particular spindle 84 and which is provided at either end with front plates 87. The hollow cylinders 86 with the front plates 87 are arranged in freely rotatable manner on the spindle 84 and are axially secured by means of retaining rings 88.

An adjusting ring 89 is fixed to the spindle 84 and a torsion spring 90 located on the spindle 84 is fixed by means of a stop 91 to the ring 89. A stop 92 is also provided on the front plate 87 associated with the torsion spring 90 and the other end of the latter engages thereon.

The particular supporting belt 76 is fixed to the hollow cylinder 86 e.g. by gumming 93. The torsion spring 90 is biased in such a way that a force acting in the winding-up direction 94 or 94a is exerted on the particular supporting belt 76. In the relatively narrow central supporting plate portion 60 is formed a slotted recess 95 running in the y-direction and into which projects the mushroom-like tubular stud 11.

When sewing in the y-direction, the sewing head 2 moves parallel to the recess 95, i.e. in such a way that the tubular stud 11 is passed into the recess 95. The supporting plate 58 with the supporting belts 76 remains fixed.

Figure 2:
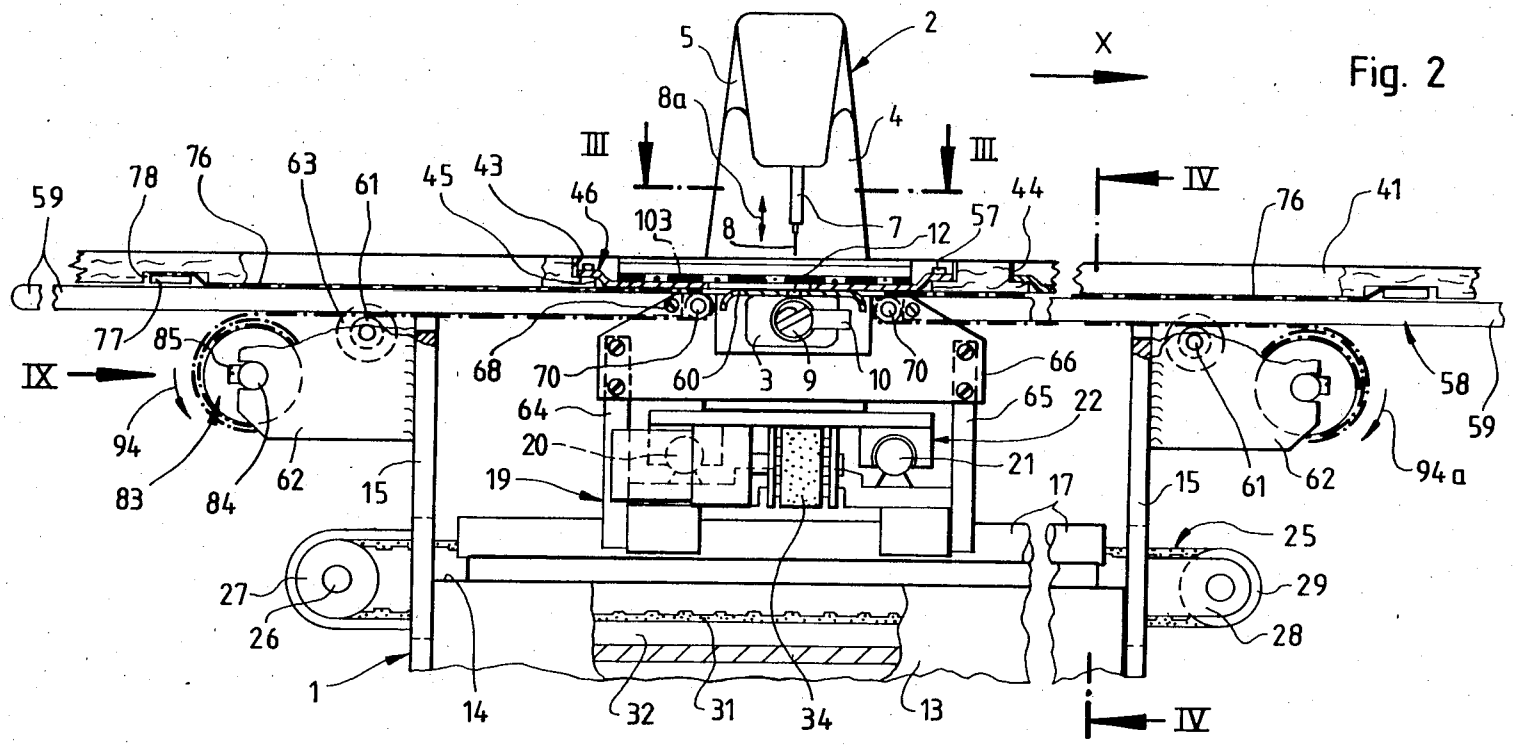
FIG. 2 is a front view taken in the direction of the arrow II in FIG. 1 in a partly broken-away representation.
Figure 3:
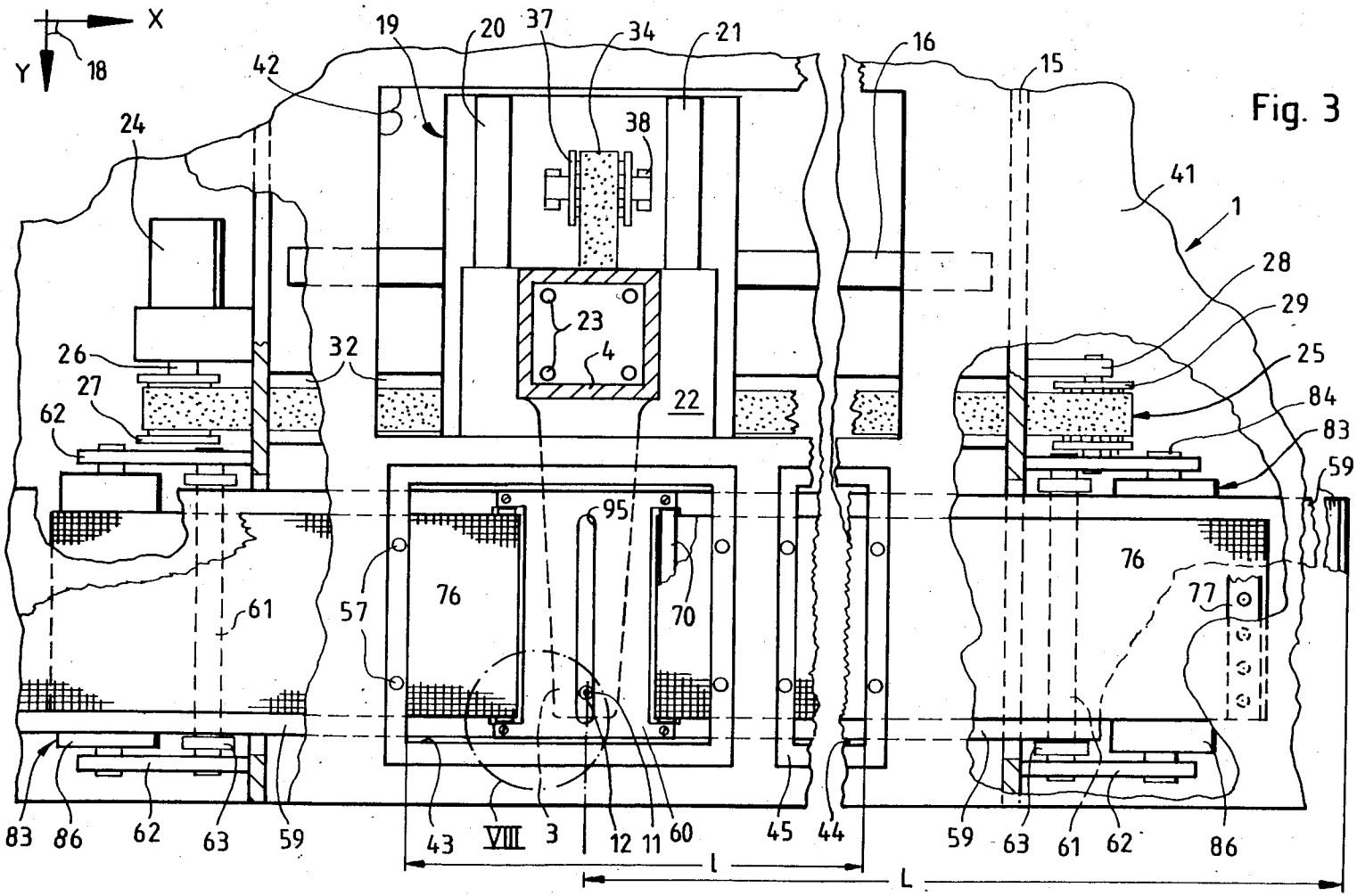
FIG. 3 is a plan view of the sewing machine in a part sectional and part broken-away representation taken on the section line III—III in FIG. 2.
Figure 4:
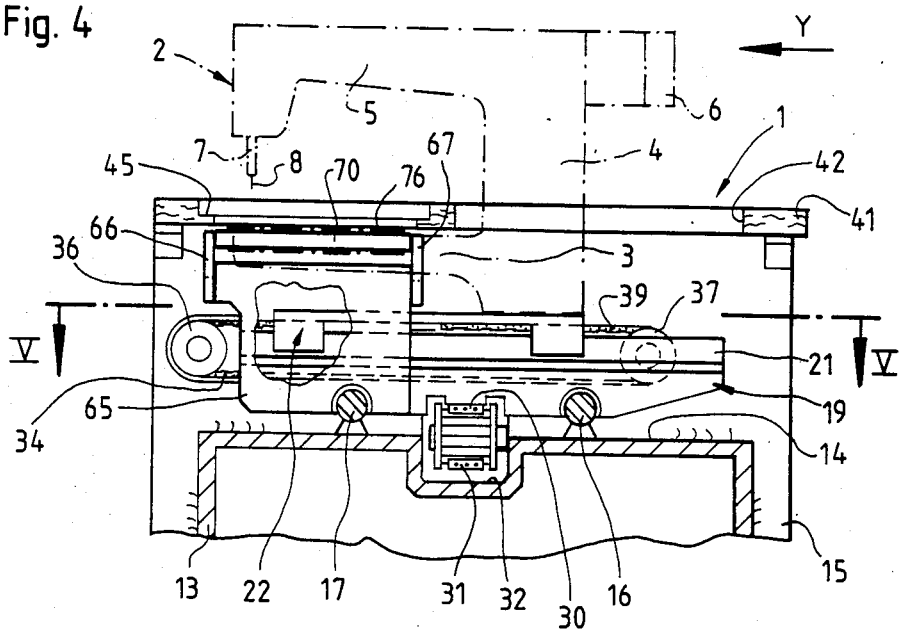
FIG. 4 is a vertical section through the sewing machine taken on the section line IV—IV in FIG. 2.
Figure 5:
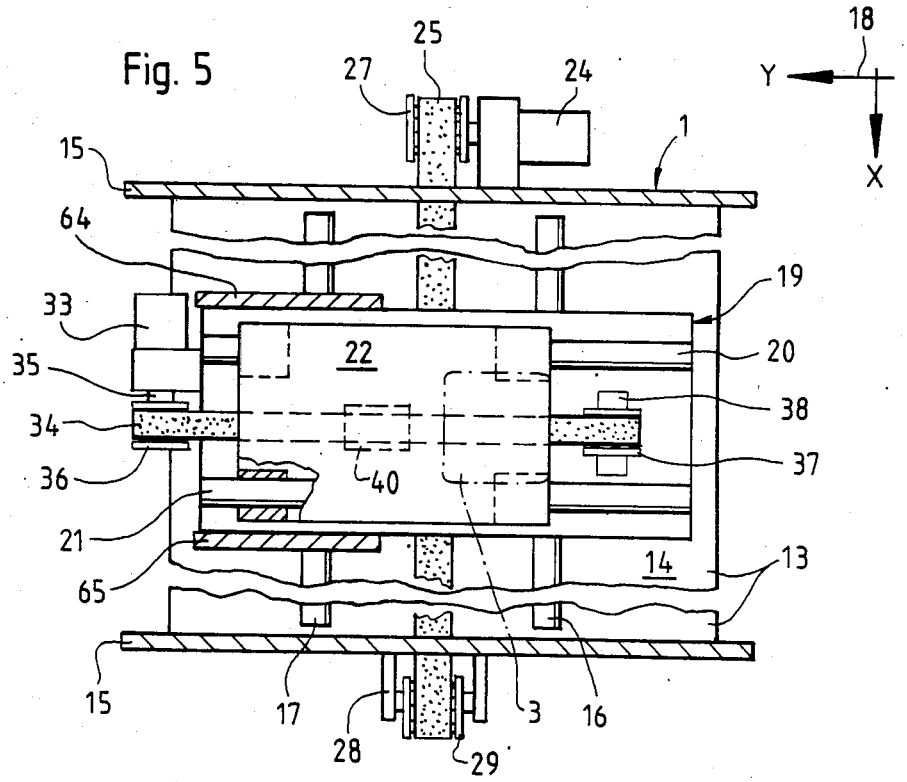
FIG. 5 is a horizontal section through the sewing machine taken on the section line V—V of FIG. 4.

As can be gathered from FIG. 3, half the length L of the supporting plate 58, measured from the recess 95 in the x-direction up to the particular outer margin, is greater than the total length l taken up by the workpiece holders 46 and 46a or the openings 43, 44 for receiving the same in the work plate 41, so that in each working position the two holders 46, 46a are supported. When moving the sewing head 2 in the x-direction the complete supporting plate 58 is driven by the x-carriage 19, i.e. the central supporting plate portion 60 and the two outer supporting plate portions 59 are moved together with the sewing head 2. Despite the relative movements of the supporting plate portions 59, 60 with respect to the work plate 41 and the workpiece holders 46, 46a, the supporting belts 76 perform no movement relative to the work plate 41 and the holders 46. The relative movement takes place between the outer supporting plate portion 59 and the inner faces of the supporting belts 76 engaging thereon. Thus, always the greater part of the lower plate 47 of the workpiece holder 46 which is operating, to the left in FIGS. 2 and 3, is supported by one or two supporting belts 76 stationary relative to the workpiece holder 46. It is only in the sewing region that supporting takes place by means of the central supporting plate portion 60, which performs a relative movement to the workpiece holder 46 in the x-direction. The other workpiece holder 46a, to the right in FIGS. 2 and 3, is completely supported by means of a supporting belt 76 which is stationary with respect thereto during the removal of a completely sewn workpiece and during charging. Particularly the charging is possible in an undistrubed manner. On moving the x-carriage 19 together with the particular supporting plate 58 in the x-direction, in each case one supporting belt 56 is wound onto the appropriate tightening and winding roll 83 and the other supporting belt 76 is correspondingly unwound from the other roll 83 and vice versa.

Figure 10:
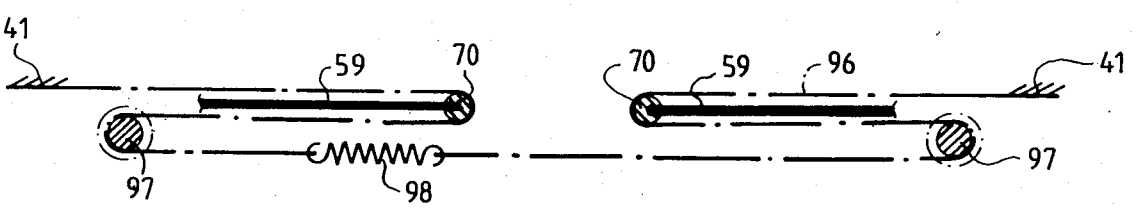
FIG. 10 is a modified embodiment of a supporting belt in diagrammic form.

In the modified embodiment according to FIG. 10, there is only a single supporting belt 96, which is fixed in the same way as the supporting belts 76 to the underside of the work plate 41 and is guided about the guide rolls 70 of the outer supporting plate portion 59. As stated, it is always returned from there and then instead of being guided by the tightening and winding rolls, this takes place by means of further guide rolls 97 located at roughly the same point. Between said two guide rolls 97, it is possible to provide in the supporting belt 96 a tightening member 98 in the form of a spring or the like, or in the form of a spring-loaded tightening roll. As the total length of the supporting belt 96 does not change, even when moving the supporting plate 58, it is only necessary to ensure the smooth, fold-free guidance of this textile supporting belt 96. If the material is sufficiently elastic, a tightening member can be rendered superfluous. Otherwise it can obviously be provided at one or both ends, where the supporting belt 96 is fixed to the work plate 41. This construction economizes the expenditure for the tightening and winding rolls 83. At the same time there is no need for the x-carriage drive to apply a force acting counter to the differential force of the two torsion springs 90. In order to keep the acceleration forces for the supporting plate 58 as small as possible, the latter and in particular the outer supporting plate portion 59 is made from a very lightweight material.

A computer 99 with an input device 100 is provided for controlling the sewing machine. The computer functions are manually programmed by means of a control panel 101. Prior to the start of a sewing process a data carrier 102, e.g. an EPROM is inserted in the input device 100 and the information contained thereon is read into the computer 99. Fundamentally the working sequence is such that the workpiece 103 located in a workpiece holder 46, shown to the left in FIG. 2, is sewn while simultaneously the already sewn workpiece is removed from the other workpiece holder 46*a*. While the aforementioned sewing process is still taking place, in said workpiece holder 46 are placed new workpiece parts to be sewn together and are secured by closing the upper plate 50, the securing of said workpiece parts essentially taking place between the freely projecting, i.e. relatively unstable plate sections 55, 54. In practice, the lower plate 47 must be made very thin, so that the workpiece is not drawn out downwards through the recess 52 in the lower plate 47 to the tubular stud 11. If the lower plate 47 and therefore also the plate section 54 are made thin, they are very unstable and can consequently not adequately secure the workpiece parts. This problem is solved by the supporting plate 58 with the supporting belts 76 or the supporting belt 96. The supporting of the lower plate 47 also facilitates the insertion of the workpiece 103. It is also ensured that the plate section 54 of the lower plate 47 is not damaged by the moving sewing head 2. The risk of injury cause by an oblique positioning between the lower plate 47 and the base plate 3 of the sewing head 2 is also obviated.

At the end of the sewing process the thread cutter 10 is operated and then the x-carriage 19 is moved in such a way that the sewing head 2 is brought into a working position above the intermediately chared other workpiece holder 46*a*. The previously sewn workpiece 103 is then free from the sewing head 2 and can be removed. This operation is also conventional and known and is e.g. described in U.S. Pat. No. 4,503,789.

What is claimed is:

1. Sewing machine controlled by a computer for producing a relative movement between a sewing head with a needle and at least one workpiece holder receiving a workpiece to be sewn during a sewing process in a plane substantially perpendicular to a direction of movement of the needle, whereby for producing said relative movement in two coordinate directions at right angles to one another servomotors controlled by said computer are provided for moving said sewing head relative to the at least one workpiece holder and whereby at the end of a sewing process the sewing head and the workpiece holder are brought into a position relative to one another in which the workpiece holder is free from the sewing head, wherein below the at least one workpiece holder is provided a supporting plate supporting the at least one workpiece holder and which supporting plate is fixed relative to said sewing head in one of said two coordinate directions and which supporting plate extends at least over the maximally possible relative movement in said one coordinate direction and which has a recess extending in the other one of said two coordinate directions for a passage of the needle.

2. Sewing machine according to claim 1, wherein between the supporting plate and the at least one workpiece holder is provided a supporting belt, which is fixed relative to said workpiece holder in both coordinate directions.

3. Sewing machine according to claim 2, wherein the supporting belt is located outside the workpiece holder and is fixed with respect thereto and is passed round a guide in the vicinity of said recess for the passage of the needle and wherein a device is provided for drawing in or releasing the supporting belt corresponding to the relative movements between the supporting plate and the workpiece holder in the one of said two coordinate directions.

4. Sewing machine according to claim 3, wherein the supporting belt is passed round a freely rotatable guide roll provided adjacent to said recess for the passage of the needle.

5. Sewing machine according to claim 3, wherein the supporting belt is fixed to a tightening and winding roll, fixed with respect to the workpiece holder and drawing in or releasing the supporting belt corresponding to the relative movement between the supporting plate and the workpiece holder.

6. Sewing machine according to claim 1 with two workpiece holders adjacent to one another in the one of said two coordinate directions, wherein the supporting plate is constructed in mirror symmetrical manner to the recess for the passage of the needle.

7. Sewing machine according to claim 6, wherein two supporting belts are provided.

8. Sewing machine according to claim 6, wherein only one supporting belt is provided.

9. Sewing machine according to claim 8, wherein a tightening member is associated with the supporting belt.

* * * * *